United States Patent [19]

Schjeldahl

[11] 4,285,187

[45] Aug. 25, 1981

[54] INTERMITTENT FEED MECHANISM FOR STACKED CONTAINERS

[76] Inventor: Gilmore T. Schjeldahl, 4436 Marlborough Ct., Minnetonka, Minn. 55343

[21] Appl. No.: 89,728

[22] Filed: Oct. 31, 1979

[51] Int. Cl.[3] ..... B65B 3/04; B65B 7/28

[52] U.S. Cl. ..... 53/282; 198/748

[58] Field of Search ..... 53/281, 282; 141/172, 141/168, 174, 195, 269, 275, 277; 198/689, 748

[56] References Cited

U.S. PATENT DOCUMENTS

| | | | |
|---|---|---|---|
| 2,029,299 | 2/1936 | Anderson | 53/282 |
| 3,187,876 | 6/1965 | Simpson | 198/689 X |
| 3,487,622 | 1/1970 | Mueller | 53/282 |
| 3,529,638 | 9/1970 | Angell et al. | 53/281 X |
| 3,554,364 | 1/1971 | Lane et al. | 198/748 X |

*Primary Examiner*—Horace M. Culver

*Attorney, Agent, or Firm*—Orrin M. Haugen; Thomas J. Nikolai

[57] ABSTRACT

A container handling and filling system for sequentially selecting, filling, and capping individual containers stored in a nested stack. The system includes first, second, and third sequentially arranged container handling sub-systems for moving individual containers through the handling and filling system, with the first sub-system including a container transfer drive in the form of an endless web having a container gripping member secured thereto, and arranged for reciprocal to-and-fro linear motion to initially transport individual containers from a nested stack to the second container handling sub-system. The second container handling sub-system includes a vertically reciprocable pad for intermittently raising individual containers to a filling station, and rotating the containers while in the elevated disposition. The reciprocating pad preferably includes a flanged rim which is arranged to move vertically reciprocably with the pad, and is further adapted to drop beneath the plane of the pad to permit individual containers to be loaded and unloaded therefrom. The third container handling sub-system which receives a filled container from the filling station, includes a container lidder drive in the form of an endless web for receiving the filled container from the reciprocating pad and for moving the filled container through a lidder station for applying and sealing a lid or cap onto the filled container. Means are provided for detecting the presence of a container in the filling station to avoid inappropriate activity of the filling means.

8 Claims, 11 Drawing Figures

INTERMITTENT FEED MECHANISM FOR STACKED CONTAINERS

BACKGROUND OF THE INVENTION

The present invention relates generally to an improved method and apparatus for the handling of individual containers, such as pails, including removing the lowermost container from a nested stack, and transferring the removed container to a filling station, and thereafter filling and capping such container or a series thereof with useful commodities, such as edible commodities, including ice cream and the like, and also for pulverulent solid commodities such as soap, detergents, and the like. The apparatus of the present invention is specifically designed to efficiently and reliably manipulate individual containers, such as pails, by moving an individual container from a nested stack onto a filling station, and thence ultimately to a lidding a capping station, with the apparatus being specifically designed for high speed reliable operation.

In the packaging of certain commodities, such as, for example, ice cream or the like, carrying containers or pails are provided for the convenient packaging of the product, as well as for convenient carrying or handling of the product by the consumer. Containers of this type are normally fabricated from synthetic resins such as polyethylene, or from composition board, or the like. These empty containers typically are frusto-conical, shaped in the form of truncated cones, or may alternatively be shaped so as to have a generally rectangular cross-section tapering toward the base. Such containers are normally nested so as to conserve storage volume and shipping volume for the empty containers.

Traditionally, these containers have a base, an upper rim, and an outwardly projecting stacking shoulder which is formed along the periphery of the container body and at a location spaced from the upper rim. A generally "U"-shaped carrying bail is secured to opposed side walls of the container at opposed midway points and between the stacking shoulder and the upper rim. When free-hanging, the carrying bail will normally rest against the outer periphery of the body at a downwardly extending or declining angle. When in stacked or nested disposition, these carrying bails frequently interfere with the vertical separation of the bottom or lowermost container of the stack, the carrying bail of the penultimate or higher ordered container in the stack frequently becoming entangled with the upper rim of the lowermost container in the stack. The apparatus of the present invention provides means for controllably positioning the carrying bail of the penultimate and higher ordered containers in a stacked column of containers so as to permit controlled and orderly vertical separation of the lowermost container of the stack. Apparatus for handling such containers are disclosed in U.S. Pat. Nos. 4,082,203 and 4,157,767, the substance of each being incorporated by reference herein.

In U.S. Pat. No. 4,082,203, there is described a machine for sequentially depositing frusto-conical containers from a stack onto a receiving surface which includes apparatus for ensuring that the bail of the penultimate container in the stack will not interfere with the separation of the lowermost container from the stack. The machine of the aforereferenced patent is particularly suited to the handling of containers having a generally circular cross-section.

In the past, apparatus has been designed for the handling of superimposed stacked receptacles, and for the loading and capping thereof, however such devices have frequently been cumbersome, slow, or unreliable in operation. In accordance with the present invention, however, means are provided for efficiently removing or selecting individual containers from the nested stack, and for delivering such containers individually, one at a time, to a filling station. In the filling station, means are provided for elevating the container to the level desired for initiating fill, and thereafter, optionally, slowly dropping the container while the filling proceeds. All during the filling operation, the container is rotated about its central axis so as to achieve a level fill but may be also used for achieving special designs by adding a flavor in the form of a special round ribbon as "Revel" ice cream. Means are provided for protecting the disposition of the receptacle by a flanged lip which is intermittently present.

Upon completion of the filling operation, the filled container is dropped to a desired level, whereupon the flanged lip is displaced or removed, and the incoming unfilled container then jogs the filled container onto an additional conveying system where the presence of the incoming container is detected, and thereafter a lid is applied and sealed onto the filled container.

SUMMARY OF THE INVENTION

Therefore, it is a primary object of the present invention to provide an improved method and apparatus for the handling of superimposed containers, and for the filling and capping of these containers on a fast, efficient, and reliable operation.

It is a further object of the present invention to provide an improved apparatus for the handling, filling and capping of individual box-like containers from a stacked column of such containers, and wherein means are provided for controllably holding and rotating individual containers while filling is being accomplished.

It is yet a further object of the present invention to provide an improved apparatus for the handling of individual box-like containers such as containers having the form of a truncated cone, and wherein the containers are initially removed from the stack on a one-by-one basis, and ultimately delivered to a filling station where the presence of individual containers is determined and wherein the containers are rotated during filling so as to achieve a uniform fill, and are thereafter delivered to a capping station where a lid is applied and secured to the filled container.

Other and further objects of the present invention will become apparent to those skilled in the art upon a study of the following specification, appended claims, and accompanying drawings.

DESCRIPTION OF THE PREFERRED EMBODIMENT

Figure 2:
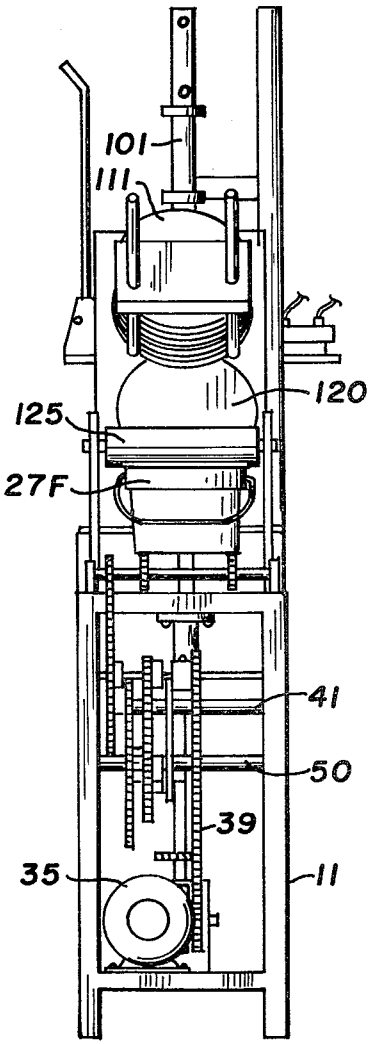
FIG. 2 is an end elevational view of the apparatus illustrated in FIG. 1, with the view being taken from the output end of the apparatus.
Figure 1:
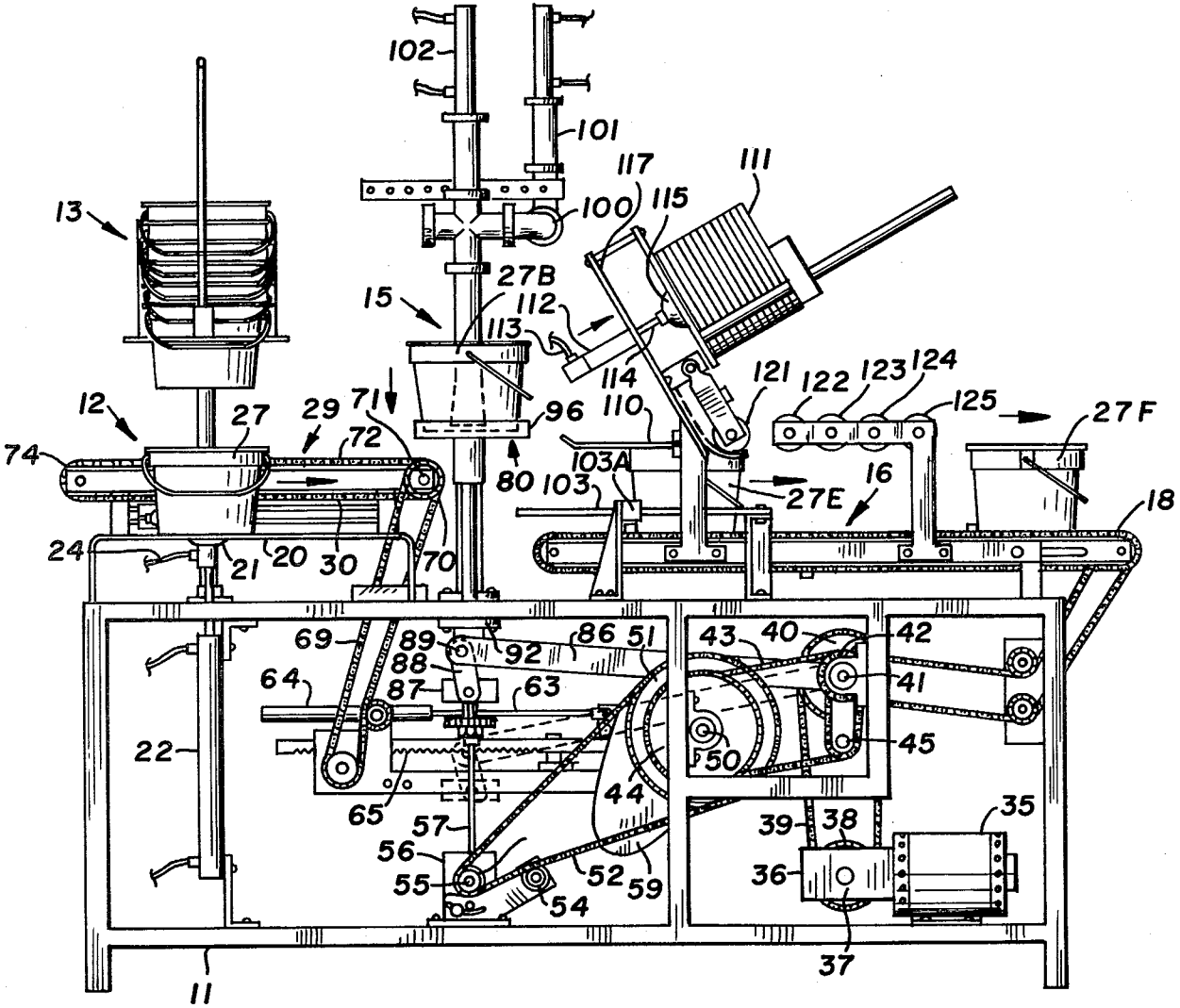
FIG. 1 is a front elevational view of the container handling and filling apparatus of the present invention, and illustrating a number of containers in various dispositions as they move through the system.
Figure 4:
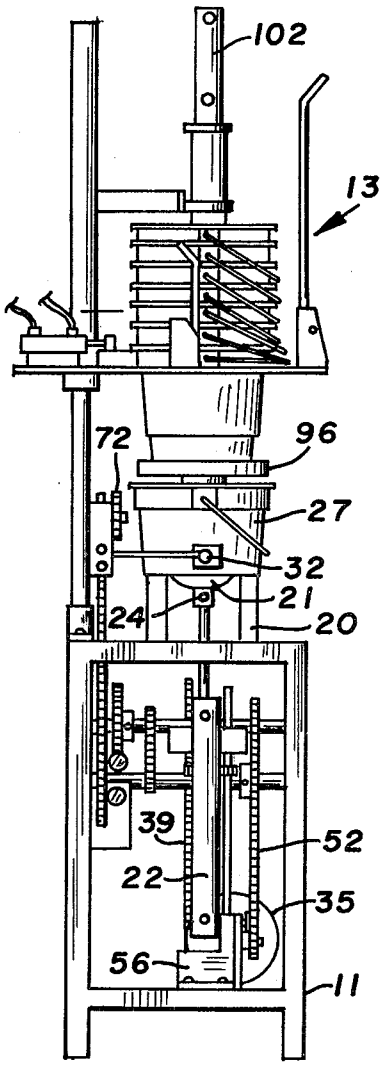
FIG. 4 is an end elevational view of the apparatus, and illustrating the apparatus from the container supply end.

In accordance with the preferred embodiment of the present invention, and with particular attention being directed to FIG. 1 of the drawings, the container handling and filling apparatus generally designated 10 includes a frame arrangement 11 upon which are mounted a plurality of container handling and filling stations. Specifically, a first container handling sub-system, which is generally the container selection and transfer sub-system is generally designated 12, and is adapted to select containers from the stack 13, and transfer them on a one-at-a-time basis to the filling station or system generally designated 15. Following filling, the filled containers are delivered to the lidding and sealing sub-system shown generally at 16. Filled and lidded or capped containers are delivered from the system at the output end thereof, such as at 18.

With particular attention being directed to the initial sub-system, the container stack 13 is treated in accordance with that certain container handling apparatus disclosed and claimed in my previously issued patent, specifically U.S. Pat. No. 4,082,203. This station, therefore, sequentially deposits the frusto-conical containers from the stack 13 onto a receiving surface which is defined by the support pad or rails 20. Also, a reciprocating suction cup, such as is illustrated at 21, is designed to remove the individual containers on a sequential basis from the stack 13, with the vertical reciprocal motion being obtained from double-acting cylinder 22, and with the cup 21 being coupled to a vacuum system, such as is illustrated at 24. The details of such apparatus are illustrated and discussed in U.S. Pat. No. 4,082,203. In order to achieve reliability, the system is provided with a limit switch which functions with the container engaging cup 32, wherein an air valve control switch is actuated and wherein the bracket supporting the container engaging cup 32 is in its fully retracted position, thereby permitting the pail feeder vacuum cup 21 to operate.

Figure 5:
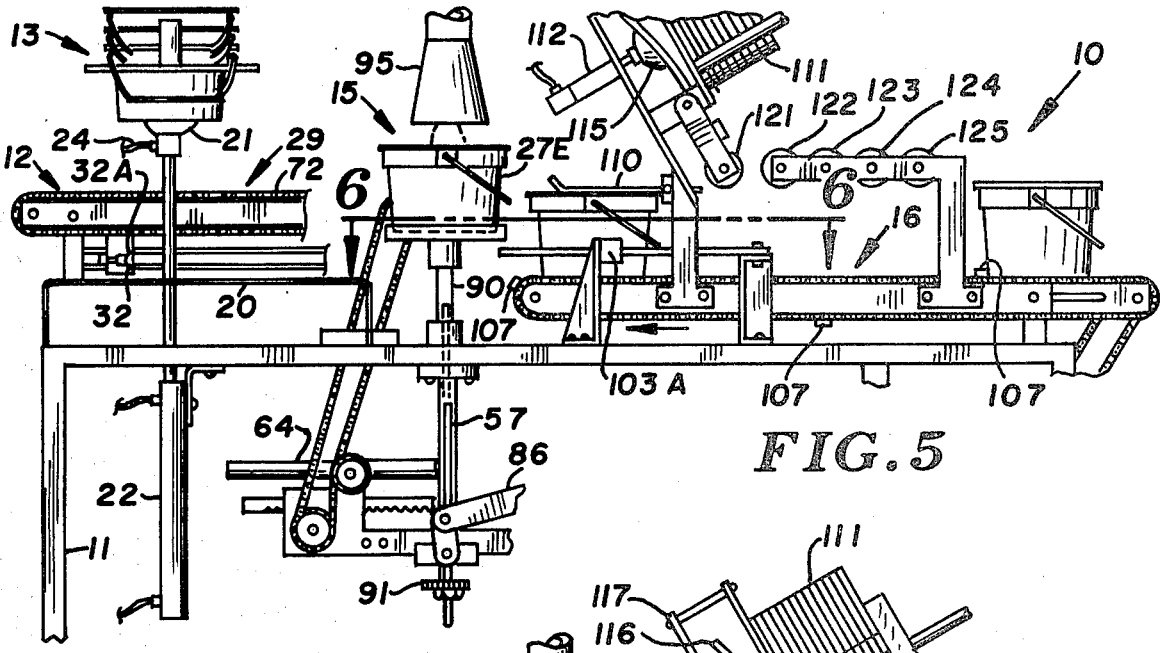
FIG. 5 is a side elevational view, partially broken away, of the apparatus illustrated in FIG. 1, and illustrating the disposition of the apparatus as a filled container is moving through the capping station, and further illustrating the disposition of a container which is leaving the filling station and entering the disposition wherein the flanged rim will be released.

Upon reaching the surface of support 20, individual containers, such as container 27, are moved along the support 20 by the transfer mechanism shown generally at 29. Transfer mechanism 29 includes a first endless chain 30, which operates on a reciprocating basis, with the configuration of the motion of the transfer apparatus being illustrated in detail in FIG. 3. It suffices to state at this point, however, that the container transfer mechanism 29 includes a container engaging cup 32 (as best illustrated in FIG. 5), which is secured to endless chain 30, and which advances and retracts in response to the motion of chain 30. Specifically, endless chain 30 together with container engaging cup 32, is designed to transfer the container in a generally horizontal linear path from the container stack toward and onto the receiving pad of the filling station. It is this motion which deposits the empty container onto a receiving pad and which forces the filled container into the incoming section of the lidding and sealing sub-system, all of which will be more fully described hereinafter.

Figure 3:
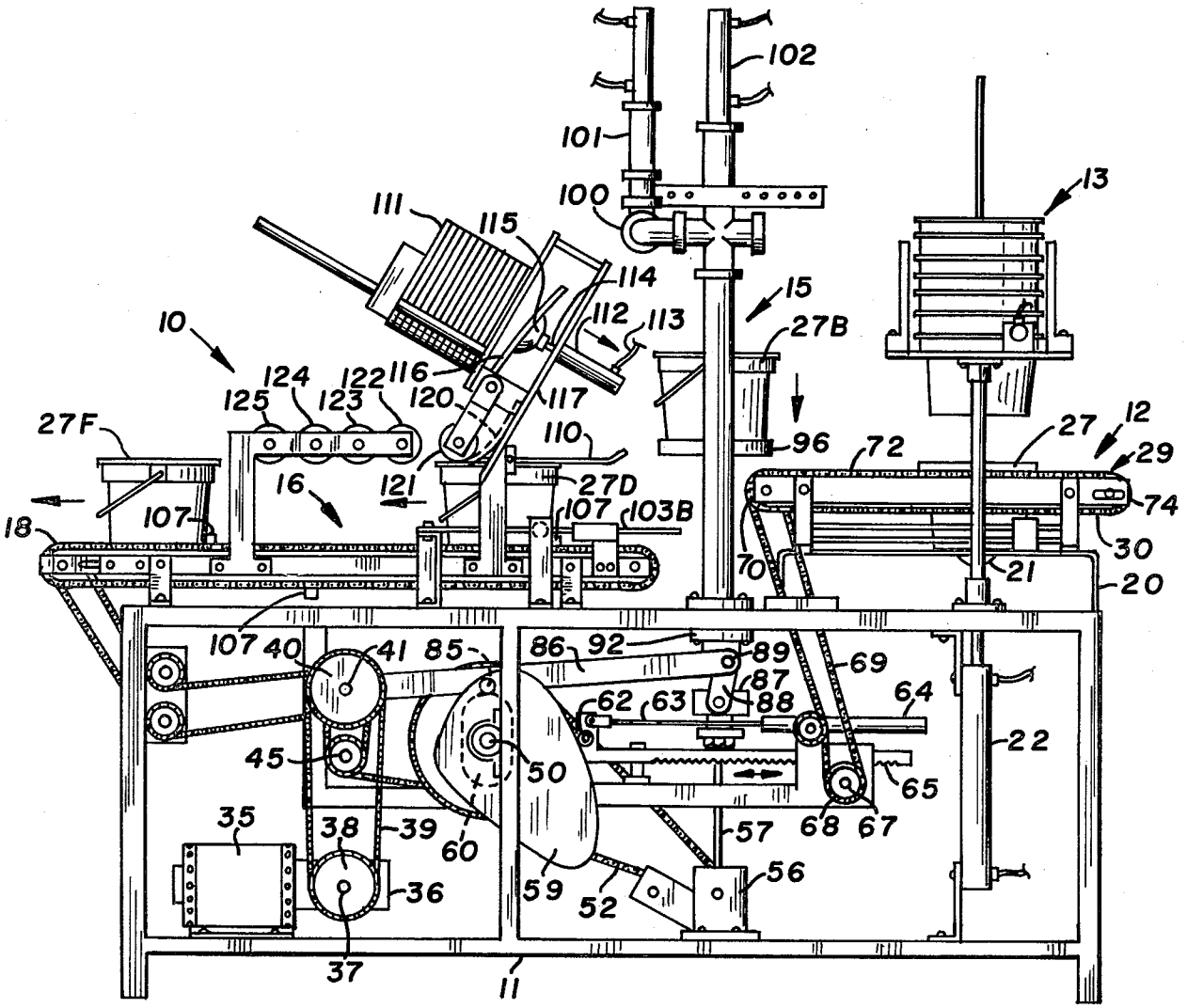
FIG. 3 is a rear elevational view of the apparatus illustrated in FIG. 1.

With continued attention being directed to FIGS. 1 and 3, it will be seen that motor 35 is utilized to power the container transporting mechanism of the transfer and filling system. Motor 35, preferably electrical motor 35, has its output shaft coupled to a transmission 36, which delivers rotary motion to shaft 37. Sprocket 38 is fast on shaft 37, and drives endless chain 39. Chain 39 is meshed with a second sprocket 40, which, in turn, is fast on shaft 41. Also on shaft 41 is a second sprocket, specifically sprocket 42 which has teeth meshed with endless chain 43. Chain 43 is, in turn, meshed with the teeth of sprocket 44, with chain 43 being trained about sprockets 42, 44 and idler sprocket 45.

Sprocket 44 is fast on shaft 50, with shaft 50 further carrying sprocket 51. Shaft 50 becomes, in effect, the main drive shaft for the entire system, with all of the machine functions being timed off of the rotation of shaft 50. Sprocket 51 engages endless chain 52, which, in turn, is further meshed with sprocket 53. Idler sprocket 54 is utilized to maintain tension in chain 52. Sprocket 53 is fast on shaft 55, which, in turn, is coupled to transmission 56 for providing rotary motion about a vertical axis, and, in turn, driving square drive shaft 57.

With continued attention being directed to FIG. 3, it will be seen that shaft 50 carries cams 59 and 60 thereon, with cams 59 and 60 rotating with shaft 50. Cam 59 engages cam follower 62, which, in turn, provides reciprocatory to-and-fro motion for shaft 63. Shaft 63 is coupled, at its free end, to cam follower spring tube 64, thereby maintaining contact between the surface of cam 59 and cam follower 62. Rack 65 moves with cam follower 62, and, is in turn, in mesh with a pinion (not shown), for providing rotary motion, intermittent and in opposed directions, to shaft 67. Shaft 67 is further provided with sprocket 68, which is utilized to drive endless chain 69 thereabout. Chain 69, at its opposed end, is in driving relationship to sprocket 70, with sprocket 70, in turn, driving shaft 71 and providing intemittent motion to endless chain 72, with the intermittent motion being in opposite directions. Chain 72 is trained about a second sprocket, such as idler sprocket 74. In each instance, as will be appreciated, suitable bushings or bearings are provided to support the individual shafts and permit their rotation to occur, as is conventional in this type of apparatus.

Figure 9:
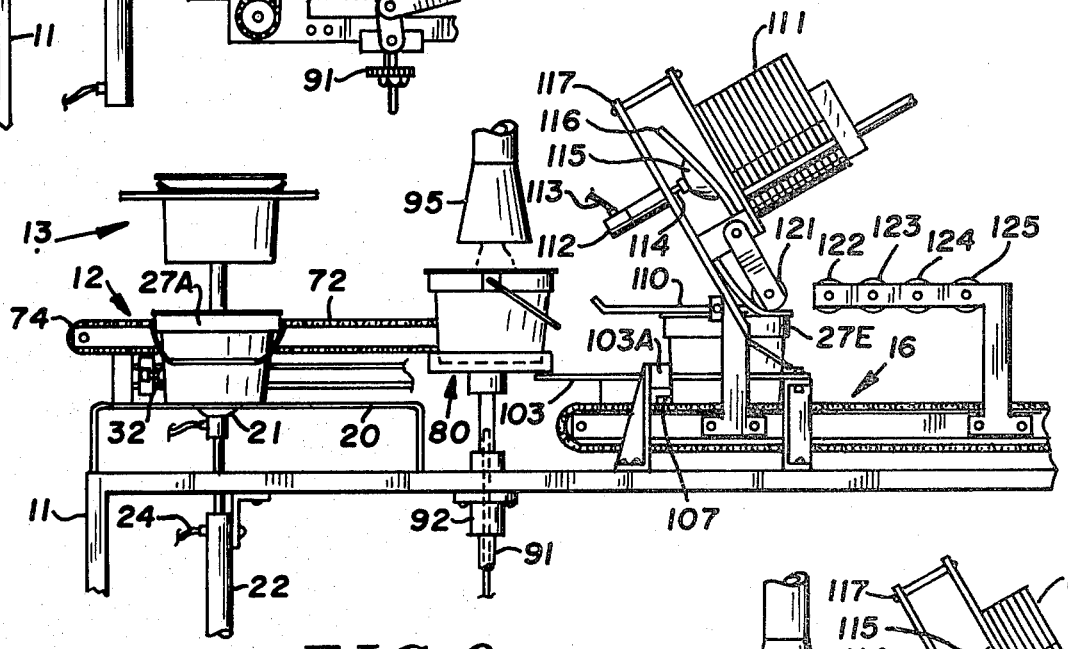
FIG. 9 is a view similar to FIG. 5, and illustrating the disposition of the filled container immediately to transfer to the capping station.
Figure 10:
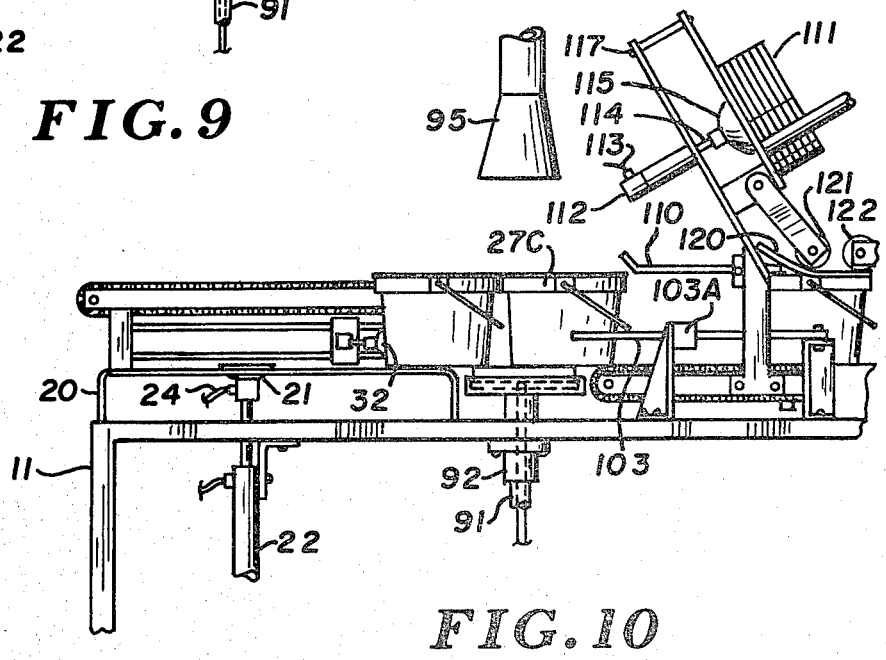
FIG. 10 is a view similar to FIG. 9, and illustrating the manner in which a filled container is transferred from the filling station to the capping station by virtue of a force applied by an incoming container from the container selection station.
Figure 11:
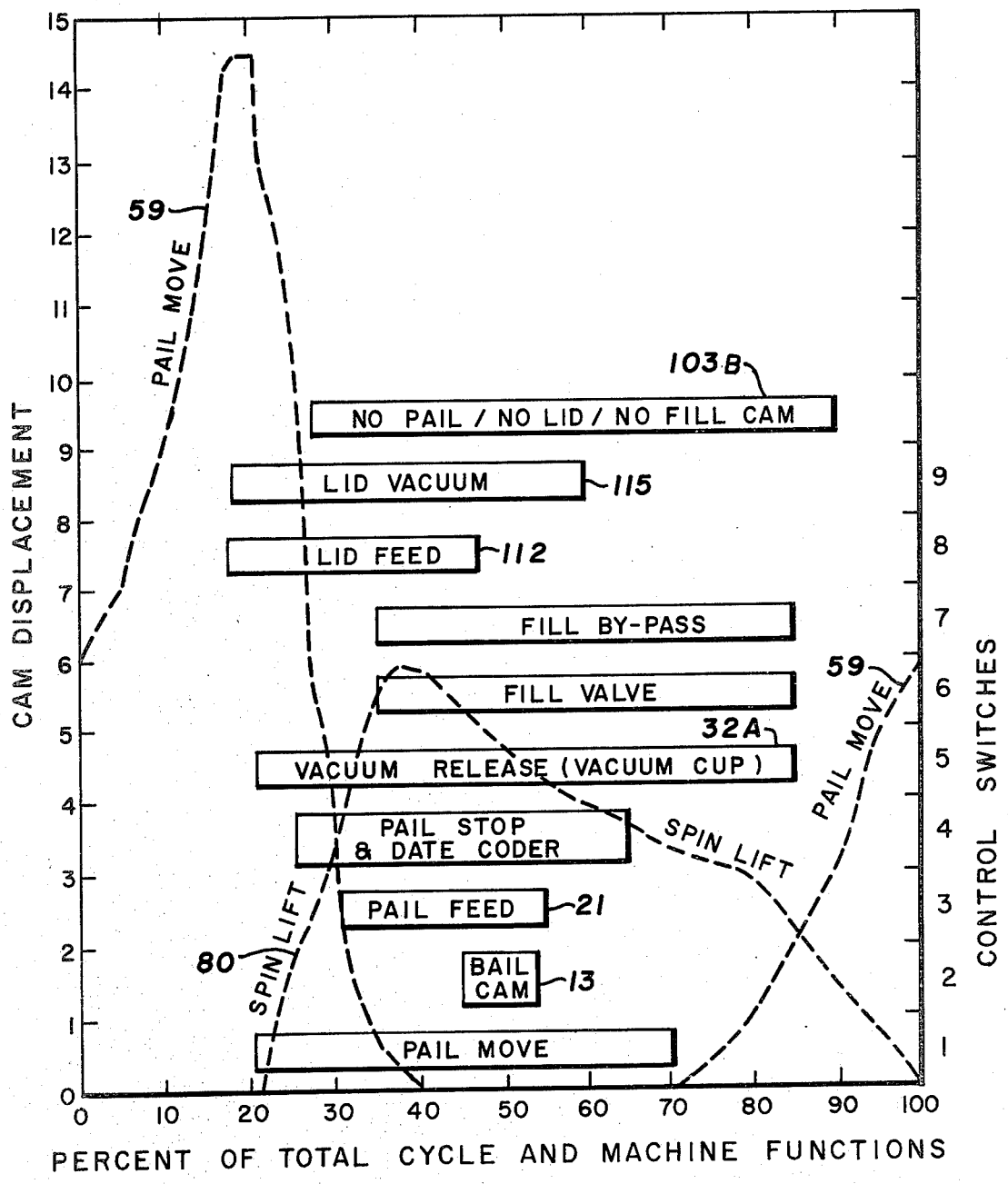
FIG. 11 is a timing logic diagram showing, in combination, cam displacement in inches, for the pail-move cam and the spin-lift cam, along with control switch actuation, each as a function of the percent of total machine cycle.

Upon delivery of an individual container, such as container 27, onto surface 20, the pushing cup 32, which is secured to and moves with chain 72, engages the rear surface of the selected container with vacuum applied, such as container 27, and moves the container from left to right in FIG. 1, as is shown in detail in FIGS. 9 and 10 of the drawings. As is apparent in FIG. 9, pusher cup 32 engages the vertical surface of the container, such as container 27, and upon motion initiated by cam 59 and cam follower 62, pusher cup 32 causes the containers, such as container 27, to move from the disposition of container 27A of FIG. 9 to the loading station, such as is illustrated in FIG. 10. Pusher cup 32 includes a vacuum cup 32A which makes secure contact with the wall of the containers, such as container 27A, and moves the container outwardly from support 20, as is illustrated in FIG. 10, and ultimately onto pad generally designated 80. The application of vacuum to cup 32A is controlled by vacuum release, as illustrated in FIGS. 1 and 11, it being clear, therefore, that during the forward motion of cam displacement by virtue of cam 59, vacuum is applied, with this release occuring at a point in time coincident with the arrival of the contianer in the filling station. Upon reaching the disposition of the container illustrated in FIG. 9, pad 80 is articulated so as to provide a flanged rim about the base of each of the contaienrs, such as container 27A. Essentially, container 27A is controllably dropped onto pad surface 81, and thereafter vertical reciprocatory motion occurs along pad 81 for elevating the container to the proper elevational position for filling.

With continued attention being directed to FIGS. 1 and 3, it will be observed that the individual container, upon being deposited on pad 81, is elevated to the proximity of the fill pipe 95, and filling occurs at that disposition. However, in order to comprehend the manner in which the individual containers are raised and lowered, attention is continued to FIGS. 1 and 3. The raising and lowering of the pad is achieved by virtue of cam 60 and cam follower 85. Cam follower 85 is secured to lift arm 86, with lift arm 86 being pivotal about shaft 41. The free end of arm 86 is provided with a lifting collar 87 which is, in turn, pivotally mounted upon trunion links 88-88, with links 88-88 being, in turn, secured to arm 86 through pin 89. Lifting collar 87 is adapted to engage and elevate housing 90 at its lower end, such as in lifting pad 91. Therefore, the arcuate pivotal rocking motion of arm 86 is translated into vertical up-and-down reciprocating motion of housing 90. Disposed within the confines of housing 90 is a square shaft 57, as indicated above. Housing 90 is slidably mounted upon square drive shaft 57, with housing 90 rotating with shaft 57. Housing 90 is journaled for pivotal up-and-down motion within bushing 92, and hence its disposition is maintained for consistent alignment between the individual containers being filled and the filling spout or tube such as is illustrated at 95.

In order to achieve intermittent raising and lowering of the flanged lip or cup 96, the extent of descent of pad surface 81 is limited, with the motion of the lifting linkage generated by arm 86 permitting the flanged lip or cup 96 to drop to a plane or level below pad surface 81, thereby permitting the incoming empty container to move the filled container from pad 81 onto the conveyor of the capping station, such as conveyor 16, as illustrated in FIG. 10.

In order to achieve filling, the individual container such as container 27B of FIG. 1, is elevated through the action of arm 86 to the disposition shown therein. As shaft 50 continues to rotate, cam 60 along with cam follower 85 will cause the individual container such as container 27B to assume the desired elevation. If desired, the profile of cam 60 may be designed so as to permit the container 27B to drop or move downwardly a distance in response to the filling activity. Rotary motion of the container in the filling position is achieved through motion of square drive shaft 57.

With continued attention being directed to FIG. 1 of the drawings, the supply of material being located into the containers is obtained through supply conduit 100, with a bypass flow control cylinder being illustrated at 101, and with shuttle valve cylinder 102 being utilized to control the filling operation. In this fashion, commodities may be accurately loaded pursuant to the weight requirements into the container being filled, such as container 27B.

Upon achieving a proper fill, the continued rotation of shaft 50 will move cam 60 to a position in which the container is lowered to the disposition illustrated in FIG. 10. At this point, the incoming empty container will push or force the filled container, such as container 27C (FIG. 10) onto the upper flight of conveyor system 16, such as at 105.

Figure 6:
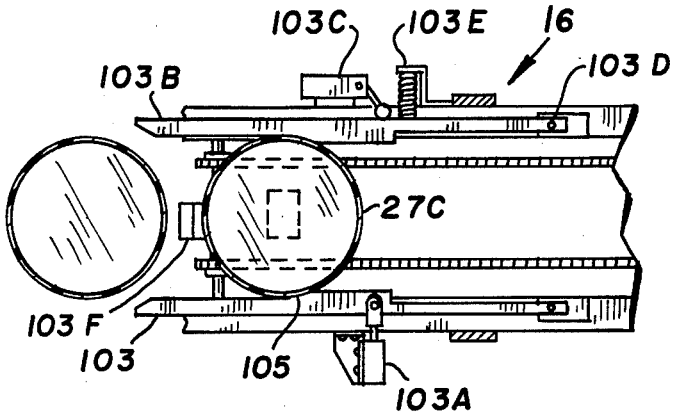
FIG. 6 is a top plan view of the incoming portion of the lidding and sealing sub-system, and illustrating the disposition of the components at a point in time when the presence of the container has been detected, and further illustrating, in partial horizontal section, the presence of a container in the filling station, as well as the container in the incoming portion of the lidding and sealing sub-system.
Figure 7:
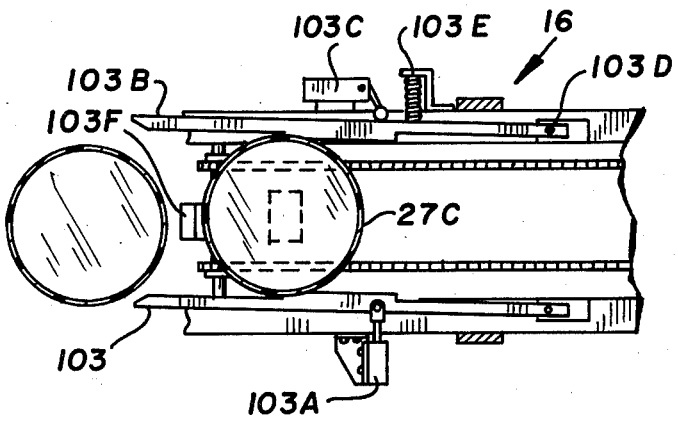
FIG. 7 is a view similar to FIG. 6, and illustrating the disposition of the filled container as it initially commences its movement through the flight of the lidding and sealing sub-system.
Figure 8:
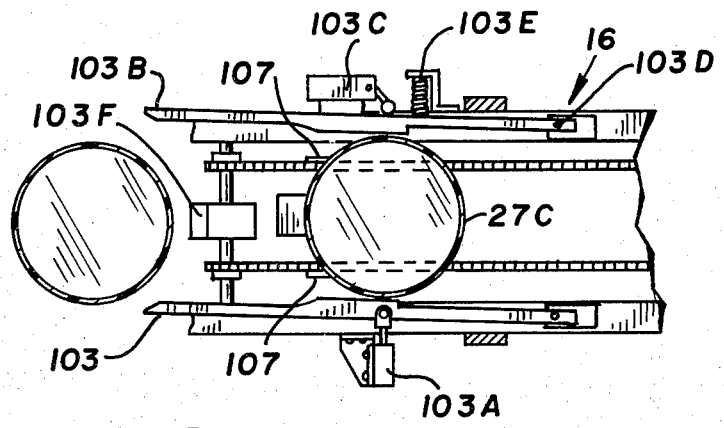
FIG. 8 is a view similar of FIGS. 6 and 7, but illustrating the disposition of the container as its moves further in the lidding and sealing sub-system, with FIGS. 6, 7 and 8 further illustrating the action and reaction of the means for detecting the presence of the filled container and hence the presence of an empty container in the filling station.

With particular attention now being directed to FIGS. 6, 7 and 8 of the drawings, it will be observed that the apparatus includes a laterally disposed bar 103 which is secured to a filled container detector cylinder 103A. Upon being pushed or forced from the filling station, the filled container will be detected by the transverse motion of bar 103, with bar 103 having sufficient force applied to the filled container so as to restrain the container until the drive dogs of the lidding conveyor make contact with the filled container. This assists in synchronizing the overall drive system.

The sequence of operation as illustrated in FIGS. 6, 7 and 8 occurs just subsequent to a point in time from the arrangement of the individual elements shown in FIG. 10. Specifically, in FIG. 6, the incoming container has forced the filled container laterally over onto the endless chain of the lidding and sealing sub-system. The rectangular block indicated in phantom in each of the views of FIGS. 6, 7 and 8, and beneath filled container 27C may be employed for imprining indicia on the container indicating the date of fill or other important information. With reference to the motion, however, solenoid 103A is triggered in response to a drive cam and bar 103 moves laterally against the wall of container 27C. Ths motion, in turn, is translated further into a lateral motion, best illustrated in FIG. 7, wherein arm 103B moves laterally to trip the contacts on switch 103C. Arm 103B is pivoted at 103D, and is biased by a spring force such as spring 103E. The presence and/or absence of a container in the disposition of container 27C will, in turn, relate to the presence of an empty container in the filling station. In order to avoid inadvertent tipping of the filled container, an incoming wedge ramp 103F is provided as indicated in FIGS. 6–8.

Individual drive cleats are provided in and along conveyor 16, such as is illustrated at 107, to engage and move the containers laterally, such as in the direction illustrated in FIG. 7. Preferably the endless chain of conveyor 16, the second chain, is provided with three sets of such drive cleats, each spaced one-third of a revolution, or 120° of chain motion, one from the other.

As indicated, the function of the transverse motion of bar 103 is to detect the presence of a filled container at that point. In the event no filled container is detected, the system will then bypass the fill, and no resumption of filling activity will occur until a fresh empty container moves the filled container from the filling station, and such container is detected in the proper position by transversly moving bar 103.

Attention is now directed to the lidding or capping station. Guide rods such as guide rods 110 control the positioning of individual filled containers, such as container 27D in FIG. 3. Individual lids are selected from the stack of lids as at 111, and applied sequentially to the filled containers. Essentially, double-acting cylinder 112 energized through line 113, is caused to move in the direction illustrated in FIG. 3, with rod 114 being retracted in response to a vacuum being imposed in line 113. Vacuum in line 113 is further translated into suction cup 115, so as to engage lid 116 from stack 111. Lid 116 is released from cup 115 when contact is made with vacuum pad 117. Lid 116 then drops downwardly by gravity to a disposition as illustrated in phantom in FIG. 1, such as at 120. The lid being rolled into place on container 27E (FIG. 1) is picked up by the advancing rim of container 27E, and is then sealed onto the container by cover application rollers including rollers 121, 122, 123, 124, and 125. The filled, capped, and seal container then leaves the system, such as is illustrated by container 27F (FIG. 1).

I claim:

1. In a container handling and filling system for sequentially selecting, filling, and capping individual containers stored in a nested stack, with said containers each having upstanding walls, a base, and an upper rim, with said system including stacking means for retaining a generally vertical column of said containers in nested relationship therein, and means for intermittently delivering the lowermost container in said column onto a first, second, and third sequentially arranged container handling sub-systems for moving individual containers through portions of said handling and filling system;

(a) said first container handling sub-system including means for sequentially delivering individual containers from said nested stack and into a container filling station for filling thereof, and comprising a first endless web having a container gripping member secured thereto and being arranged for reciprocatory to-and-fro motion to transport individual containers upon removal from said nested stack to said second container handling sub-system at and along a base plane;

(b) said second container handling sub-system including vertically reciprocable pad means for intermittently raising individual containers from said base plane to an elevated disposition adjacent a filling spout for filling and for rotating said container while in said elevated disposition for a finite period from said spout and for returning said filled container to said base plane;

(c) said third container handling sub-system including second endless web means for receiving said filled container from said reciprocating pad and for removing said filled container through a capping station for applying and sealing a cap onto said filled container.

2. The container handling and filling system as defined in claim 1 being particularly characterized in that said vertically reciprocable pad includes a flanged rim arranged to be intermittently positioned about said pad, and means for raising and lowering said flanged rim in synchronism with said pad.

3. The container handling and filling system as defined in claim 1 being particularly characterized in that cam means are provided for controllably lowering said vertically reciprocable pad in response to the degree of fill achieved within said container.

4. The container handling and filling system as defined in claim 3 being particularly characterized in that said first endless web has a linear drive path for transferring individual containers upon removal from said nested stack to a position which is along said base plane for delivering individual containers onto a predetermined position within said second container handling sub-system.

5. The container handling and filling system as defined in claim 4 being particularly characterized in that said container gripping member includes a vacuum actuated cup which is arranged to be releasably secured to a generally vertical surface of an indvidual container.

6. The container handling and filling system as defined in claim 1 wherein means are provided for detecting the presence of a filled container in said third container handling sub-system.

7. The container handling and filling system as defined in claim 6 wherein the second endless web means of said third container handling sub-system includes spaced container engaging dogs for engaging and moving filled containers therealong.

8. The container handling and filling system as defined in claim 7 wherein said detecting means includes a transversely movable restraining member for restraining motion of a filled container until said driving dogs engage said filled container.

* * * * *

UNITED STATES PATENT AND TRADEMARK OFFICE

CERTIFICATE OF CORRECTION

PATENT NO. : 4,285,187

DATED : August 25, 1981

INVENTOR(S) : Gilmore T. Schjeldahl

It is certified that error appears in the above-identified patent and that said Letters Patent are hereby corrected as shown below:

Column 8, line 9, after "finite" insert -- filling --.
Line 42, "indvidual" should read -- individual --.

Signed and Sealed this

*Third* Day of *November 1981*

[SEAL]

*Attest:*

GERALD J. MOSSINGHOFF

*Attesting Officer*

*Commissioner of Patents and Trademarks*